US005911462A

United States Patent [19]

Hui

[11] Patent Number: 5,911,462

[45] Date of Patent: Jun. 15, 1999

[54] CHOPSTICK HOLDER

[76] Inventor: Ronald Hui, 2768 Hocquart, Jonquière, Quebec, Canada, G7S 1X9

[21] Appl. No.: 08/657,551

[22] Filed: Jun. 4, 1996

[51] Int. Cl.[6] ..... A47G 21/10; A47J 43/28

[52] U.S. Cl. ..... 294/99.2; 294/33

[58] Field of Search ..... 294/1.1, 8.5, 11, 294/16, 33, 99.2, 104, 106; 30/124, 142; D7/642, 686

[56] References Cited

U.S. PATENT DOCUMENTS

| | | | |
|---|---|---|---|
| 506,479 | 10/1893 | Eagan | 294/8.5 |
| 1,490,837 | 4/1924 | Lohmann | 294/8.5 |
| 2,647,006 | 7/1953 | Coyle | 294/8.5 |
| 2,711,339 | 6/1955 | McGogy | 294/11 X |
| 3,259,415 | 7/1966 | Howard | 294/99.2 |
| 3,323,825 | 6/1967 | Arima | D7/686 X |
| 3,414,310 | 12/1968 | Ono | D7/686 X |
| 3,807,781 | 4/1974 | Rollband | D7/686 X |

*Primary Examiner*—Johnny D. Cherry

[57] ABSTRACT

A chopstick holder comprising a housing having first and second opposed side walls and first and second opposed end walls, the housing having a substantially rectangular cross sectional configuration with an open up end and an open lower end, at least one wall retaining segment extending between the first and second side walls, the wall segments being designed to define a channel for a first chopstick and being designed to retain a leaf spring which biases a second chopstick against a second end wall. One of the end walls extends downwardly a distance substantially longer than the other side wall to provide support and thereby permit use of only the index finger for operation of the chopsticks.

8 Claims, 5 Drawing Sheets

CHOPSTICK HOLDER

FIELD OF THE INVENTION

The present invention relates to chopstick holders.

BACKGROUND OF THE INVENTION

Chopsticks are widely used in certain cultures, one of the largest uses being in China. With the growing popularity of Chinese food in North American society, the use of chopsticks in eating Chinese food has become somewhat of a general practice. However, the proper use of chopsticks requires both dexterity and a certain degree of practice. For those who only use chopsticks on certain occasions, it becomes difficult to properly utilize the utensils.

Chopsticks are used as utensils for food which is served in small pieces and can therefore easily be handled thereby. They are generally slim tapered sticks having a length in the area of 25 cm and are usually made of wood or bamboo although other materials have also been used. In use, one of the chopsticks remains stationary, it being held at the base of the thumb and braced against the top of the fourth finger. The other chopstick, which is the moveable one, is held by the thumb and the index and middle fingers in a manner similar to that of a writing instrument such as a pen or pencil. The food is normally engaged between the two sticks. For most applications, it is important that the sticks move in the same plane—that they don't tend to cross each other but rather are pressed opposite each other on the food piece.

There have been proposals in the prior art for various aids for users of chopsticks. However, the prior art proposals can still require considerable dexterity by the user as they do not ensure that the chopsticks, when held together, move in the same plane.

SUMMARY OF THE INVENTION

It is an object of the present invention to provide a chopstick holder which serves as a housing for a pair of chopsticks and also as a guide for the moving chopstick when used.

It is a further object of the present invention to provide a chopstick holder which is simple to manufacture and easy to use.

It is a further object of the present invention to provide a chopstick holder wherein the moving chopstick is guided in a single plane so as to meet the fixed chopstick when used.

According to one aspect of the present invention, there is provided a chopstick holder which comprises a body having means to receive first and second chopsticks therein, the first chopstick receiving means being adapted to retain the chopstick in a first position, a second chopstick retaining means being adapted to retain the second chopstick and to permit pivotable movement of the second chopstick, and biasing means to maintain the second chopstick in a spaced relationship from the first chopstick.

In a further aspect of the present invention, there is provided a chopstick holder and guide comprising a housing having a first end wall and a second end wall opposed thereto, means joining said first and second end walls, means for retaining a chopstick adjacent to a first one of the end walls, means for retaining a second chopstick adjacent a second of the end walls, and biasing means located between the end walls acting to bias the second chopstick against the second end wall.

In greater detail, the chopstick holder according to the present invention is designed to receive a pair of chopsticks and allow the user to move one of the chopsticks relative to the other while guiding the chopstick so that they meet together when moved in a pivotable fashion.

The chopstick holder of the present invention may be formed of any suitable material such as plastic, wood, metals, composites, etc.

In the preferred embodiment, the chopstick holder is designed to retain one chopstick against an end wall of the holder in a fixed manner. In the use of chopsticks, this is conventional since only one chopstick is usually moved. The means for retaining the fixed or lower chopstick in position may be any suitable frictional engagement means may be employed.

The second or moveable chopstick is designed to move in a pivotable manner while being guided such that its end will meet the end of the fixed chopstick. For this purpose, the chopstick is only permitted to move in a single plane such that it will meet the fixed chopstick. The invention preferably includes biasing means for biasing the moveable chopstick into a spaced apart relationship with the fixed chopstick.

BRIEF DESCRIPTION OF THE DRAWINGS

Having thus generally described the invention, reference will be made to the accompanying drawings illustrating an embodiment thereof, in which.

DETAILED DESCRIPTION

Figure 4:
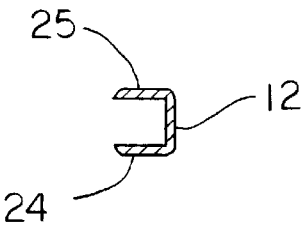
FIG. 4 is a sectional view taken along the lines B—B of FIG. 1.
Figure 3:
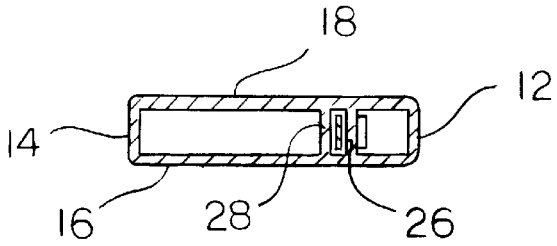
FIG. 3 is a sectional view taken along the lines A—A of FIG. 1.

Referring to the drawings in greater detail and by reference characters thereto, one embodiment of the chopstick holder of the present invention is illustrated in FIGS. 1 to 9 and which holder is generally designated by reference numeral 10.

Chopstick holder 10, as may be seen in FIGS. 1 to 4, has a first end wall 12 which is of a generally rectangular configuration and an opposed end wall 14 which is also of a rectangular configuration, but has a shorter length. Interconnecting end walls 12 and 14 are a pair of substantially identical side walls 16 and 18.

Figure 1:
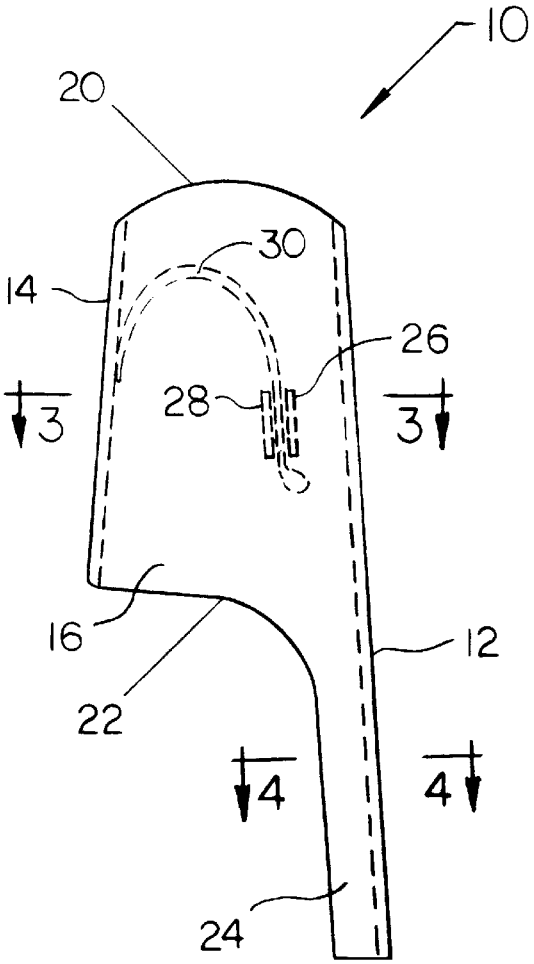
FIG. 1 is a side elevational view of a chopstick holder according to one embodiment of the present invention.

As may be seen in FIG. 1, side wall 16 has a slightly curved upper edge 20 and a bottom edge 22 which extends inwardly from end wall 14. In so doing, there is thus formed a leg portion 24 which is integral with and extends downwardly from side wall 16. A similar leg portion 25 is formed in conjunction with side wall 18.

Formed intermediate of and extending between the inner surfaces of side walls 16 and 18 are a pair of parallel wall segments 26 and 28. Wall segments 26 and 28 are relatively short and in the illustrated embodiment, are substantially parallel to end wall 12.

Figure 6:
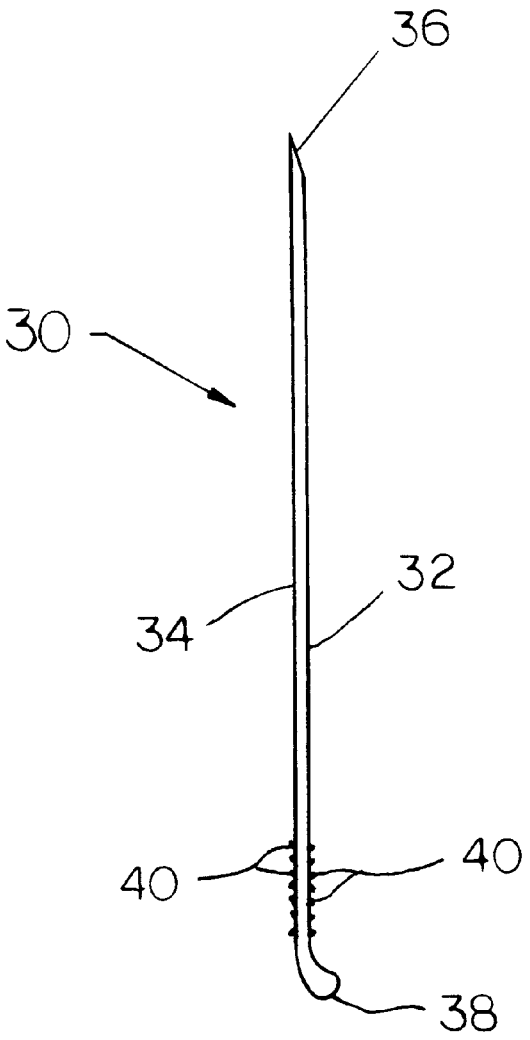
FIG. 6 is a side elevational view of the biasing spring of FIG. 5.
Figure 5:
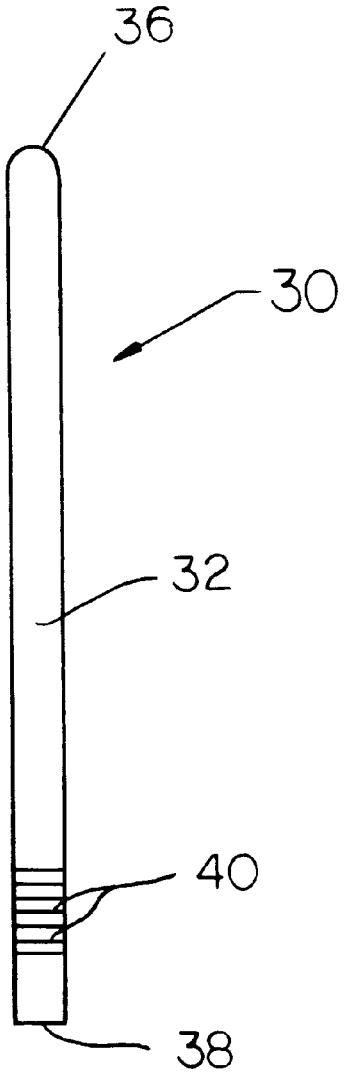
FIG. 5 is a plan view of one embodiment of a biasing spring as used in the holder shown in the embodiment of FIG. 1.

The invention includes the use of biasing means which in this embodiment is a spring member generally designated by reference numeral 30. As shown in FIGS. 5 and 6, spring member 30 is a substantially rectangular member formed of a suitably resilient material (plastic or metal are preferable); spring member 30 has a pair of substantially planar opposed sides 32 and 34. A first end 36 has a slightly rounded tapered configuration as seen in FIGS. 5 and 6 while a second end 38 has an enlarged portion. Adjacent enlarged end 38 are a plurality of raised parallel ribs 40 on both side 32 and side 34.

Figure 2:
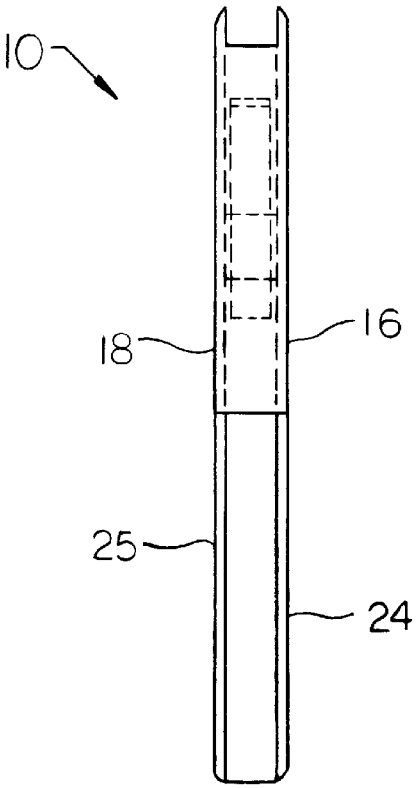
FIG. 2 is an end elevational view as seen from the left hand side of FIG. 1.

In operation, spring member 30 is inserted in the holder, as shown in FIGS. 1 and 2, such that end 38 is retained between wall segments 26 and 28 with ribs 40 assisting in maintaining the spring in the desired position. End 36 of spring member 30 is adapted to abut an interior surface of end wall 14 after being bent in an arcuate configuration (see FIG. 1).

Figure 10:
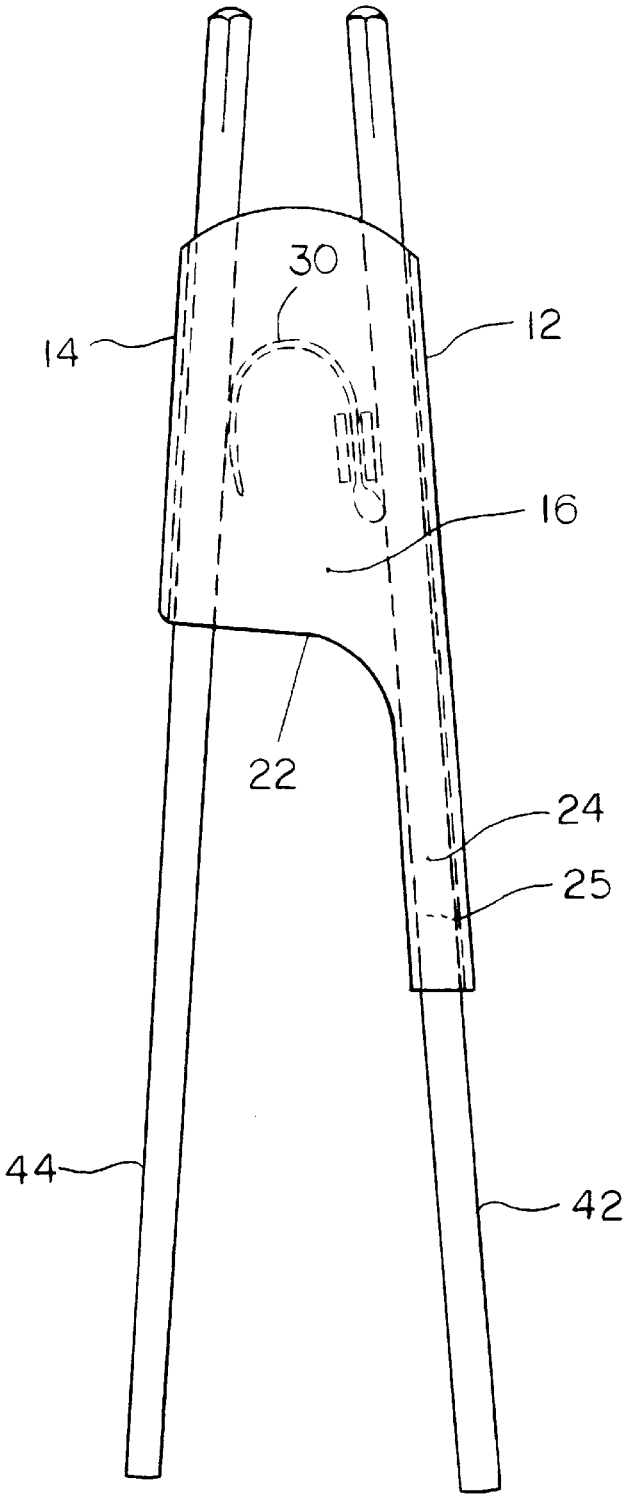
FIG. 10 is a side elevational view similar to the view of FIG. 1, but illustrating the mounting of chopsticks in the holder.

The holder is sized such that the space between wall segment 26 and the inner surface of wall 12 is adapted to receive a chopstick 42 which may be inserted and retained therein (see FIG. 10). Subsequently, a second chopstick 44 is inserted adjacent the inner surface of end wall 14 (see FIG. 10) with spring member 30 biasing chopstick 44 against the end wall 14. Chopsticks 42 and 44 should be inserted approximately an equal distance such that the tops lie in the same plane as do the bottoms of the chopsticks.

Figure 7:
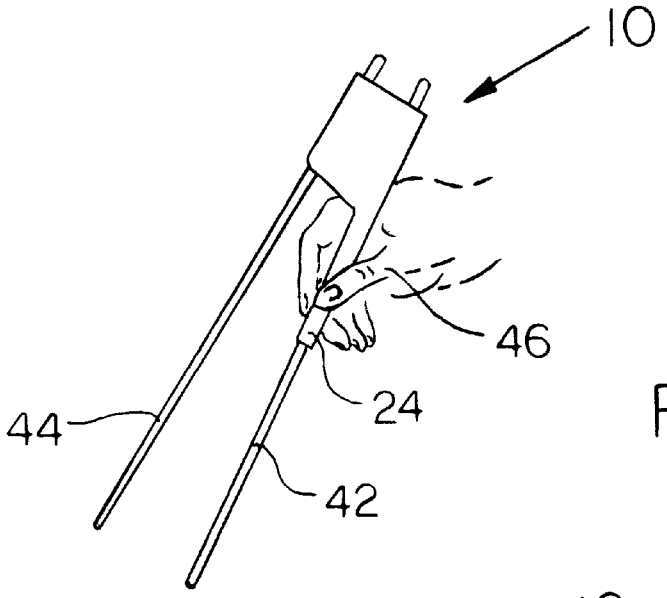
FIGS. 7 to 9 illustrate operation of the chopsticks and chopsticks holder of the present invention.
Figure 8:
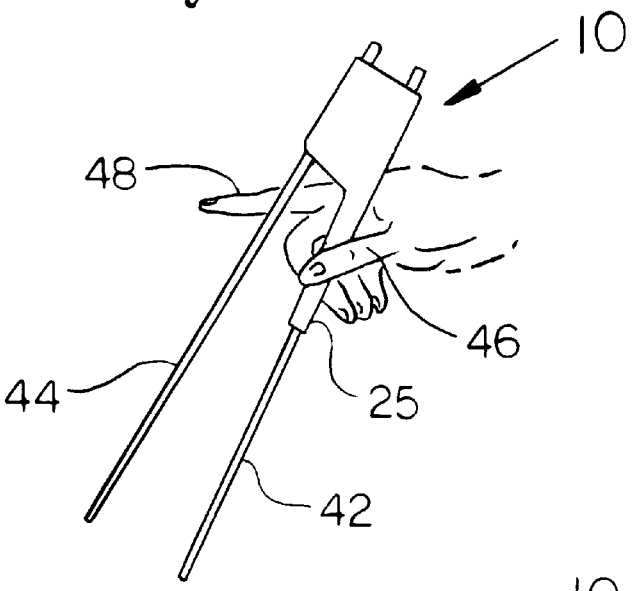
Figure 9:
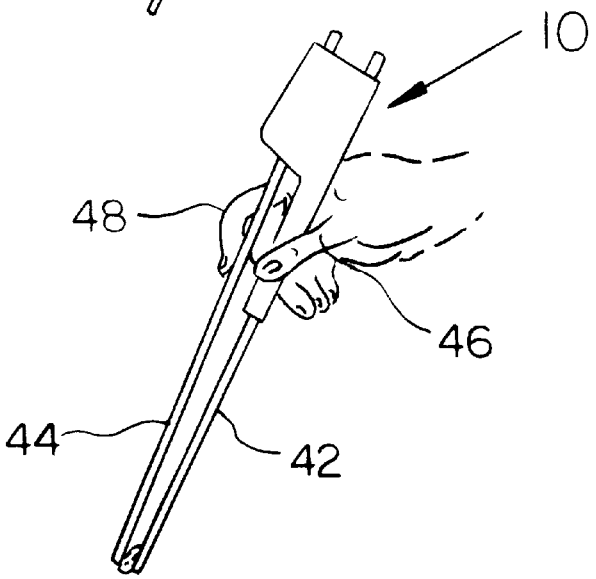

In use, and as shown in FIGS. 7 to 9, legs 24 and 25 are gripped between thumb 46 and the hand of the user. This will retain chopstick 42 in position; the user may then place an index finger 48 over chopstick 44 as shown in FIG. 8. Thus, the pressing of the index finger 48 will cause movement of chopstick 44 towards chopstick 42 thus enabling the user to pick up any food. Releasing of pressure by index finger 48 will permit spring member 30 to bias chopstick 44 to its original position.

As may be seen from the above, pressing and release of chopstick 44 with index finger 48 will allow the user to handle the chopsticks with ease and to pick up food securely and elegantly.

Figure 13:
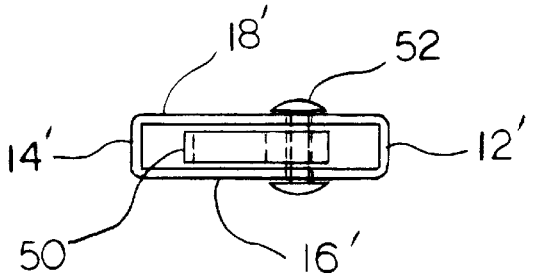
FIG. 13 is a top plan view thereof.
Figure 12:
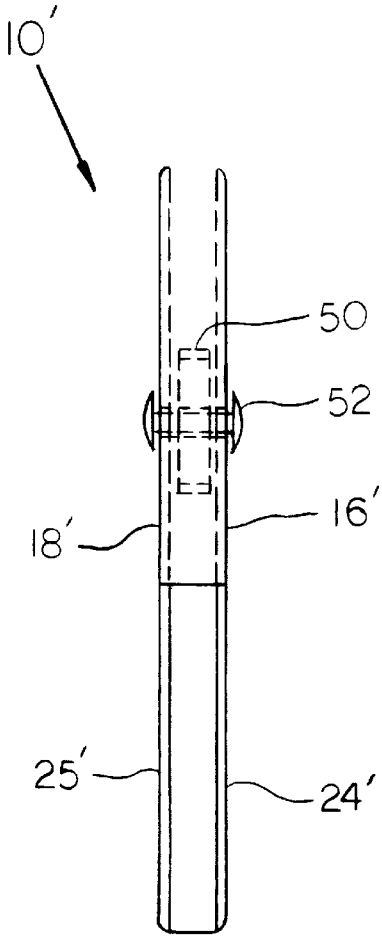
FIG. 12 is an end elevational view as seen from the left hand side of FIG. 11.
Figure 11:
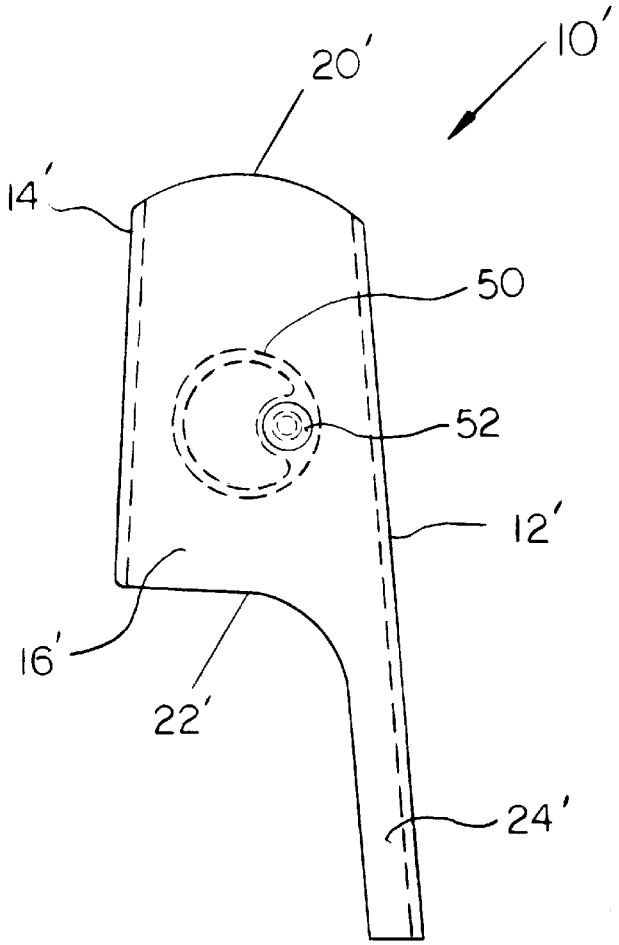
FIG. 11 is a side elevational view of a second embodiment of a chopstick holder according to the present invention.

A further embodiment is illustrated in FIGS. 11 to 13. In this embodiment, similar reference numerals are used for similar components except with a prime. In this embodiment, a ring 50 is secured between side walls 16' and 18' by means of a rivet type device generally designated by reference numeral 52. Resilient ring 50 may be formed of any suitable resilient material such as plastic and would be adapted to retain a chopstick against end wall 14'.

It will be understood that the above described embodiments are for purposes of illustration only and that changes and modifications may be made thereto without departing from the spirit and scope of the invention.

The embodiments of the invention in which an exclusive privilege or property is claimed are defined as follows:

1. A chopstick holder consisting essentially of a housing having a first side wall, a second side wall spaced therefrom, a first end wall extending between said first and second side walls, and a second end wall extending between said first and second side walls, said housing having a substantially rectangular cross sectional configuration with an open upper end between said first and second side walls and said first and second end walls, and an open lower end between said first and second side walls and said first and second end walls, each of said first and second side walls and said first and second end walls having a substantially uniform thickness, at least one spring retaining wall segment extending between said first and second side walls, said spring retaining wall segment being located proximate said first end wall to define a first chopstick receiving channel between said first end wall and said spring retaining wall segment, said first end wall and a portion of each of said first and second side walls adjacent said first end wall extending downwardly from said open lower end a distance substantially greater than a distance of said second end wall to thereby define a U-shaped channel for receiving the first chopstick, and a leaf spring having first and second end portions within said housing, a first end portion of said leaf spring being retained by said wall segment, a second end portion of said leaf spring being retained by said wall segment, said second end portion of said leaf spring being arranged to exert a biasing force against a second chopstick to retain the second chopstick against said second end wall.

2. The chopstick holder of claim 1 wherein said housing is formed of a plastic material.

3. The chopstick holder of claim 1 including a second spring retaining wall segment slightly spaced from said first spring retaining wall segment, said first end of said leaf spring being retained between said first and second wall retaining wall segments.

4. The chopstick holder of claim 3 wherein said first end of said leaf spring has an enlarged portion.

5. The chopstick holder of claim 4 wherein said leaf spring includes a plurality of ribs along a portion thereof retained between said first and second spring retaining wall segments.

6. In combination, a chopstick holder consisting essentially of first and second chopsticks, a housing having a first side wall, a second side wall spaced therefrom, a first end wall extending between said first and second side walls, and a second end wall extending between said first and second side walls, said housing having a substantially rectangular cross sectional configuration with an open upper end between said first and second side walls and said first and second end walls, and an open lower end between said first and second side walls and said first and second end walls, each of said first and second side walls and said first and second end walls having a substantially uniform thickness, at least one spring retaining wall segment extending between said first and second side walls, said spring retaining wall segment being located proximate said first end wall to define a first chopstick receiving channel between said first end wall and said spring retaining wall segment, said first end wall and a portion of each of said first and second side walls adjacent said first end wall extending downwardly from said open lower end a distance substantially greater than a distance of said second end wall to thereby define a U-shaped channel for receiving the first chopstick, and a leaf spring having first and second end portions within said housing, a first end portion of said leaf spring being retained by said wall segment, a second end portion of said leaf spring being retained by said wall segment, said second end portion of said leaf spring being arranged to exert a biasing force against said second chopstick to retain said second chopstick against said second end wall.

7. The chopstick holder of claim 6 wherein said housing is formed of a plastic material.

8. The chopstick holder of claim 6 including a second spring retaining wall segment slightly spaced from said first spring retaining wall segment, said first end of said leaf spring being retained between said first and second wall retaining wall segments.

* * * * *